US005246074A

United States Patent [19]

Ayres

[11] Patent Number: 5,246,074

[45] Date of Patent: Sep. 21, 1993

[54] SLIP STREAM DEVICE WITH ADJUSTABLE CHOKE, AND METHOD OF CHOKING A FLUID FLOW PATH

[75] Inventor: Robert N. Ayres, Houston, Tex.

[73] Assignee: Baker Hughes Incorporated, Houston, Tex.

[21] Appl. No.: 755,484

[22] Filed: Sep. 5, 1991

[51] Int. Cl.[5] ..... E21B 37/06

[52] U.S. Cl. ..... 166/310; 166/90; 166/91; 166/312; 166/902

[58] Field of Search ..... 166/75.1, 90, 91, 310, 166/311, 312, 304, 902; 175/49

[56] References Cited

U.S. PATENT DOCUMENTS

| | | | |
|---|---|---|---|
| 1,645,686 | 10/1927 | Brady | 166/75.1 X |
| 1,758,376 | 5/1930 | Sawyer | 166/312 |
| 2,167,393 | 7/1939 | Muncy | 175/49 |
| 2,801,697 | 8/1957 | Rohrback | 166/902 X |
| 4,106,562 | 8/1978 | Barnes et al. | 166/75.1 X |
| 4,436,148 | 3/1984 | Maxwell | 166/902 X |
| 4,796,697 | 1/1989 | Ayres | 166/90 |
| 4,830,112 | 5/1989 | Erickson | 166/304 |
| 4,896,726 | 1/1990 | Ayres | 166/312 |
| 5,103,914 | 4/1992 | LaHaye | 166/310 |

*Primary Examiner*—Hoang C. Dang
*Attorney, Agent, or Firm*—Melvin A. Hunn; Mark W. Handley

[57] ABSTRACT

An apparatus is provided for continually adding chemicals to a producing oil and gas well. A mixing chamber is provided having an inlet and an outlet. A subassembly is provided for diverting a flow of production fluid from the well and directing the flow of production fluid to the inlet of the mixing chamber. A subassembly is provided for admitting an amount of chemical into the mixing chamber. The fluid mixture of the production fluid and the chemical is exhausted from the mixing chambers through the outlet. A flow control system is provided, in fluid communication with the outlet of the mixing chamber, for permitting only a predetermined flow rate of the fluid mixture to exit from the mixing chamber. An adjustment control is provided for adjusting the flow rate of the fluid mixture through the mixing chamber to selectively increase and decrease the predetermined flow rate. An exhaust system is provided for conveying the fluid mixture from the outlet, through the flow control, and into the well. The fluid mixture flushes downwardly into the well, and is pumped upwardly through the tubing.

68 Claims, 7 Drawing Sheets

SLIP STREAM DEVICE WITH ADJUSTABLE CHOKE, AND METHOD OF CHOKING A FLUID FLOW PATH

BACKGROUND OF THE INVENTION

1. Field of the Invention

This invention relates to a device and method for adding chemicals to a producing oil and gas well to enhance production. This invention also relates to a method and apparatus for choking a fluid flow path.

2. Background of the Invention

This invention relates to a device and method for efficiently and reliably adding chemicals, on a continuous basis, to a producing oil and gas well to eliminate undesirable conditions such as paraffin build-up, corrosion, and the like.

In a typical oil and gas well, oil is pumped upwardly through a central tubing string by either a sucker-rod type pump or by a downhole pump. The tubing string is surrounded by casing. Gas typically travels upwardly through the casing. Oil and gas enter the tubing and casing from the formation through perforations in the casing. Perforations are subject to plugging, and the pump and tubing are subject to build-up of scale and damage by corrosion.

In general, a producing oil well is subject to emulsion or paraffin build-up, build-up of scale within the tubing, and corrosion. Without treatment these conditions can reduce or stop production.

In the case of paraffin build-up, it is a common industry practice to periodically treat the well with hot oil, trucked to the site. The truck pumps hot oil down the casing and back up the tubing. This process removes deposits of paraffin by melting the paraffin. A triplex injection truck is also used to treat downhole corrosion and scale problems. The truck batch-treats the well by pumping chemicals down the casing and back up the tubing using typically three or four barrels of water to flush the chemicals down the casing. The truck must inject several gallons of chemicals per treatment to have the desired effect.

A slip stream device is described and claimed in U.S. Pat. Nos. 4,796,697 and 4,896,726. The slip stream device is adapted to automatically and continuously inject well treatment chemicals to a producing oil and gas well. This slip stream device uses a small amount of the production fluids (including oil and water) as a carrier for production enhancing chemicals. In this device, a small amount of production fluid is diverted to a mixing chamber, and mixed with a selected performance-enhancing chemical. The mixture is directed into the well on an automatic and continual basis.

SUMMARY OF THE INVENTION

It is one objective of the present invention to provide a slip stream device for continually and automatically combining production fluids from an oil and gas well with selected production-enhancing chemicals and injecting the mixture into the well.

It is another objective of the present invention to provide a slip stream device for use in injecting selected chemicals into an oil and gas well which includes means for dislodging debris which becomes lodged in the fluid flow paths of the slip stream device, to ensure automatic and continuous injection of selected chemicals into the oil and gas well.

It is still another objective of the present invention to provide a slip stream device for use in injecting selected production-enhancing chemicals into an oil and gas well which includes a fluid flow choke which is operator-adjustable.

It is yet another objective of the present invention to provide a slip stream device for use in injecting selected production-enhancing chemicals into an oil and gas well which responds to flow-obstructing debris within the choke mechanism by automatically adjusting the choke to allow passage of the debris through the choke.

These and other objectives are achieved as is now described. An apparatus is provided for continually adding chemicals to a producing oil and gas well. A mixing chamber is provided having an inlet and an outlet. A means for diverting is provided for diverting a flow of production fluid from the well and directing the flow of production fluid to the inlet of the mixing chamber. A means is provided for admitting an amount of chemical into the mixing chamber. The fluid mixture of the production fluid and the chemical is exhausted from the mixing chambers through the outlet. A flow control means is provided, in fluid communication with the outlet of the mixing chamber, for permitting only a predetermined flow rate of the fluid mixture to exit from the mixing chamber. An adjustment means is provided for adjusting the flow rate of the fluid mixture through the mixing chamber to selectively increase and decrease the predetermined flow rate. A means is provided for conveying the fluid mixture from the outlet, through the flow control means, and into the well. The fluid mixture flushes downwardly into the well, and is pumped upwardly through the tubing.

DETAILED DESCRIPTION OF THE INVENTION

Figure 1:
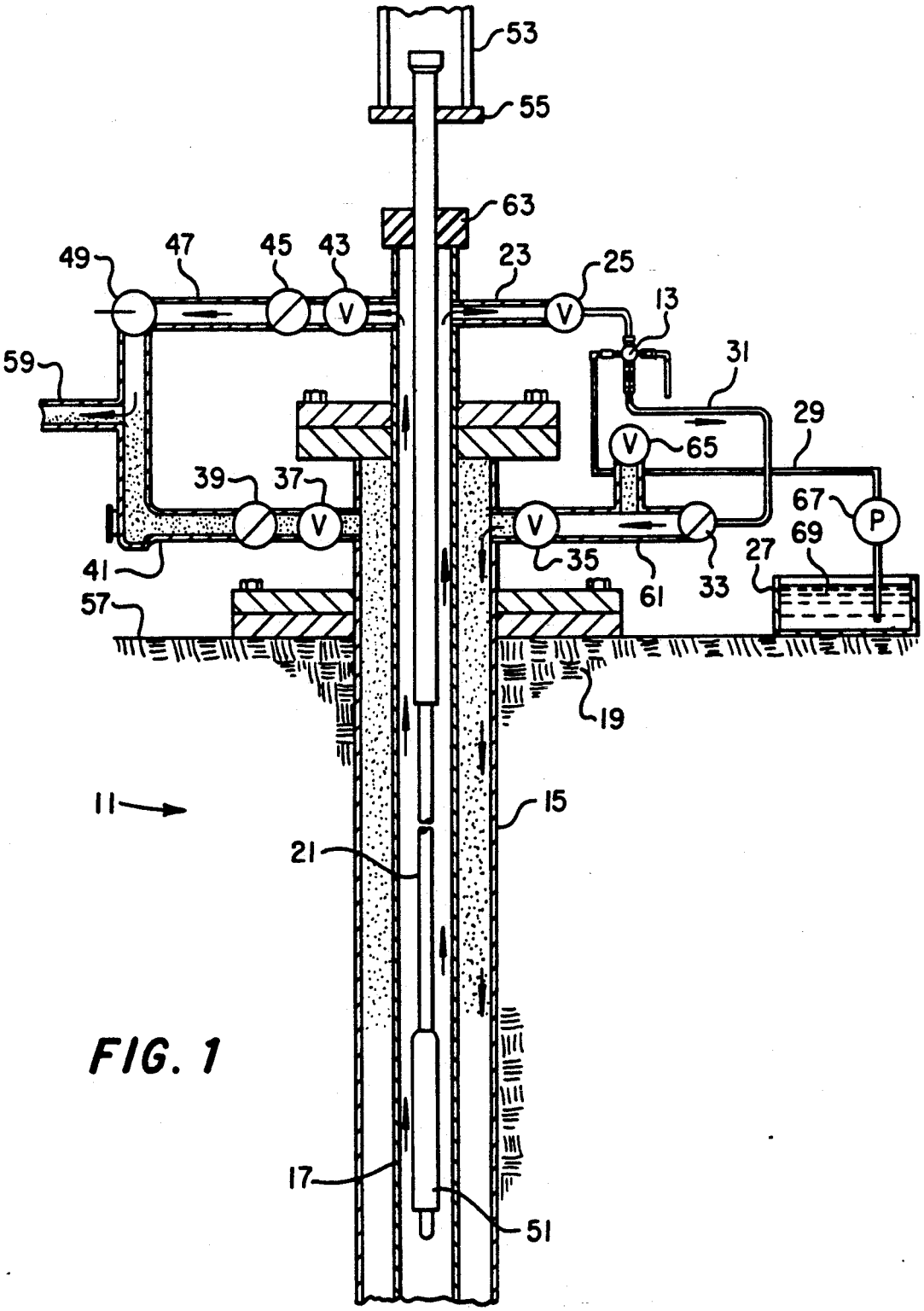
FIG. 1 is a simplified partial longitudinal section view of an oil well equipped with the preferred slip stream device of the present invention.

FIG. 1 is a simplified partial longitudinal section view of an oil and gas well 11, equipped with the preferred slip stream device 13 of the present invention.

Oil and gas well 11 includes casing 15 and tubing 17, with tubing 17 concentrically disposed within casing 15. Casing 15 and tubing 17 extend downward from the earth's surface 57 into formation 19. Downhole pump 51 is suspended within tubing 17 by sucker rod string 21, and is reciprocated upward and downward within the wellbore by a walking beam (not shown). Sucker rod string 21 extends into oil and gas well 11 through stuffing box 63 and is coupled to the walking beam by bridle 53 and clamp 55.

Typically, oil and gas enter casing 15 through perforations (not shown) therein. Ordinarily, other fluids, such as water, and salt water, are produced along with the oil. Together, all fluids produced from the oil and gas well 11 are generally referred to as "production fluids." These production fluids are lifted from oil and gas well 11 by downhole pump 51. Natural gas, and other gases, rise within oil and gas well 11 in the annular space between tubing 17 and casing 15.

At the surface, most production fluids are directed to oil flow conduit 47, but a small portion of the production fluids are directed to bypass conduit 23. Natural gas, and other gases, are directed to gas flow conduit 41. The natural gas and production fluids are joined together at production conduit 59, and pumped to holding tanks, processing equipment, and pipelines.

In a typical oil and gas well, a number of valves are provided at the well head which cooperate to direct the flow of natural gas and production fluids. The flow of natural gas to gas flow conduit 41 can be controlled by operation of casing valve 37. Casing check valve 39 is disposed downstream from casing valve 37, and operates to prevent the back-flow of natural gas and production fluid into the annular space between casing 15 and tubing 17.

The flow of production fluid is likewise controlled by valving. The flow of production fluid into bypass conduit 23 is controlled by operation of valve 25. The flow of production fluid into oil flow conduit 47 is controlled by the tubing valve 43. Tubing check valve 45 is provided downstream from tubing valve 43, and operates to prevent the back flow of production fluid into tubing 17.

Feedback conduit 61 is provided to allow for the passage of fluids into the annular space between casing 15 and tubing 17. Feedback conduit 61 is accessible through valve 35, which operates to allow or prevent passage of fluids into the annular space between casing 15 and tubing 17.

In the present invention, slip stream device 13 may be coupled either between bypass conduit 23 and feedback conduit 61, or to oil flow conduit 47. In the embodiment shown in FIG. 1, slip stream device 13 is coupled between bypass conduit 23 and feedback conduit 61. Production enhancing chemical 69, which is disposed in reservoir 27, is pumped by pump 67 into slip stream device 13 via injection line 29. The production-enhancing chemical 69 is mixed with production fluids within slip stream device 13, and exhausted via exhaust line 31 into feedback conduit 61 for injection into oil and gas well 11 in the annular space between casing 15 and tubing 17.

A variety of production enhancing fluids can be used with the slip stream device 13 of the present invention, including scale inhibitors, corrosion inhibitors, emulsion breakers, paraffin inhibitors, and water clarifying agents, to accomplish a variety of objectives. The present invention is not limited to the use of any particular chemical or production-enhancing agent.

Figure 2A:
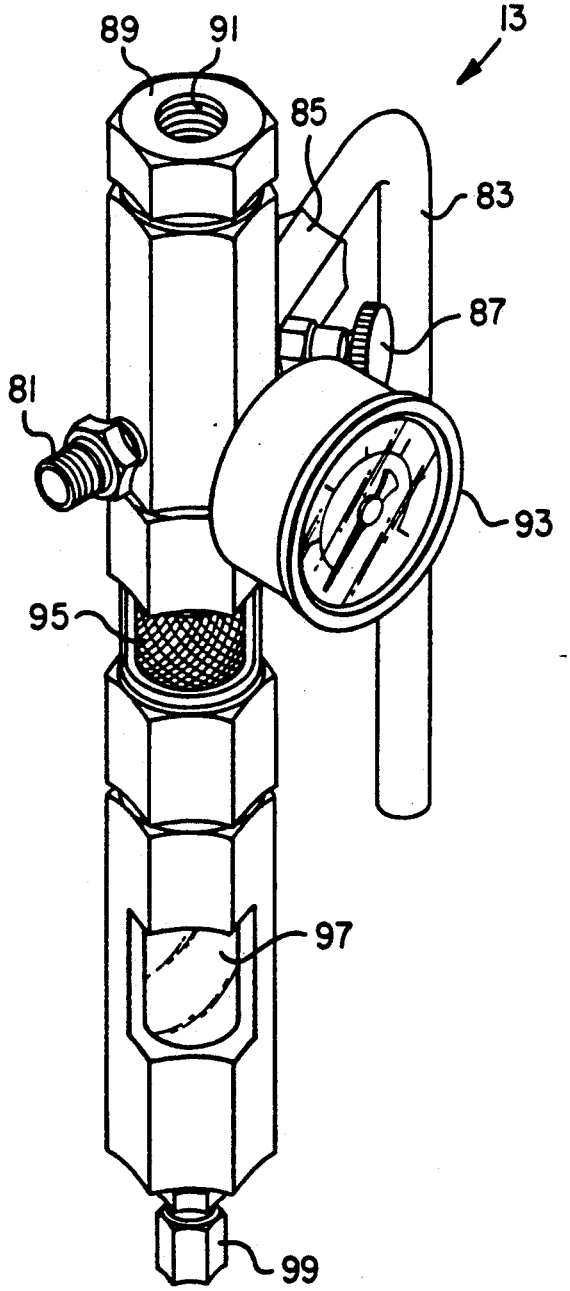
FIGS. 2*a* and 2*b* are perspective views of the preferred slip stream device of the present invention.

Slip stream device 13 is better shown in FIG. 2*a*, which is a perspective view of the preferred embodiment of the slip stream device 13. As shown, slip stream device 13 includes a threaded chemical injection inlet 81 for releasably coupling with injection line 29. Slip stream device 13 also includes inlet connector 89 which couples slip stream device 13 to bypass conduit 23 through valve 25. Inlet 91 directs a flow of production fluid into slip stream device 13 for mixture with production-enhancing chemicals 69 which are passed into the interior of slip stream device 13 through chemical injector inlet 81.

It is desirable to be able to test the mixture of production fluid and production-enhancing chemicals. Sample line 83 allows such testing, and is coupled through sample inlet 85 to the interior of slip stream device 13. Sample valve 87 includes a manually-operable sample valve 87 which allows for the selective discharge of test samples from the interior of slip stream device 13 through sample line 83. Sample line 83 serves another function as a pressure release valve for slip stream device 13, and allows the operator to equalize the pressure between the interior and exterior of slip stream device 13, so the device can be taken apart for repair or service.

The preferred slip stream device 13 of the present invention also includes gauge 93 for monitoring the pressure within a mixing chamber which is disposed interiorly of slip stream device 13. Human-operable adjustment control 95 allows the operator to adjust the flow rate of the mixture of the production fluid and production-enhancing chemicals through slip stream device 13. Adjustment of the rate of flow of the fluid mixture will result in an increase or decrease in the passage of fluid within the mixing chamber.

Figure 2B:
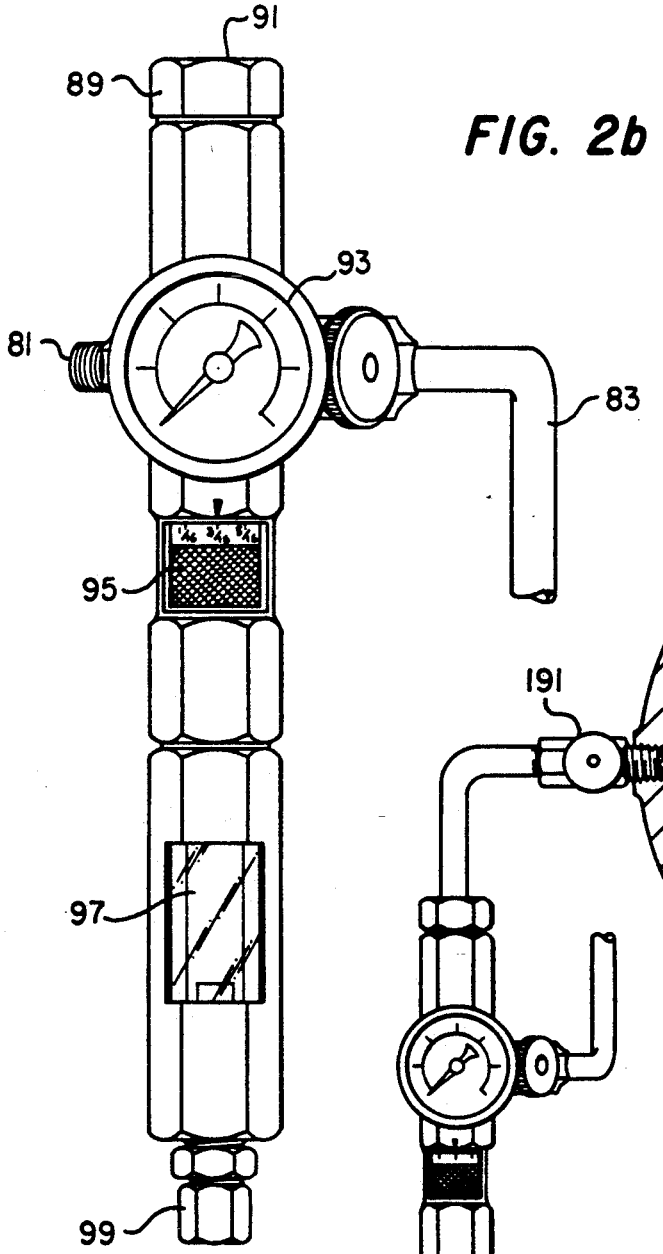

Preferably, the exterior surface of adjustment control 95 is graduated with flow rate data as shown in FIG. 2*b*. The exterior surface of adjustment control 95 is also provided with a region having a high coefficient of friction to facilitate operator adjustment of the flow rate, without requiring the use of tools. Therefore, slip stream device 13 of the present invention may be adjusted without the use of a tool, using only a thumb and forefinger. Slip stream device 13 of the present invention further includes sight glass 97 which allows the operator to view the mixture of production-enhancing chemical and production fluids as it exits the preferred slip stream device 13 of the present invention through outlet connector 99 which operates to connect slip stream device 13 to exhaust line 31.

Figure 3:
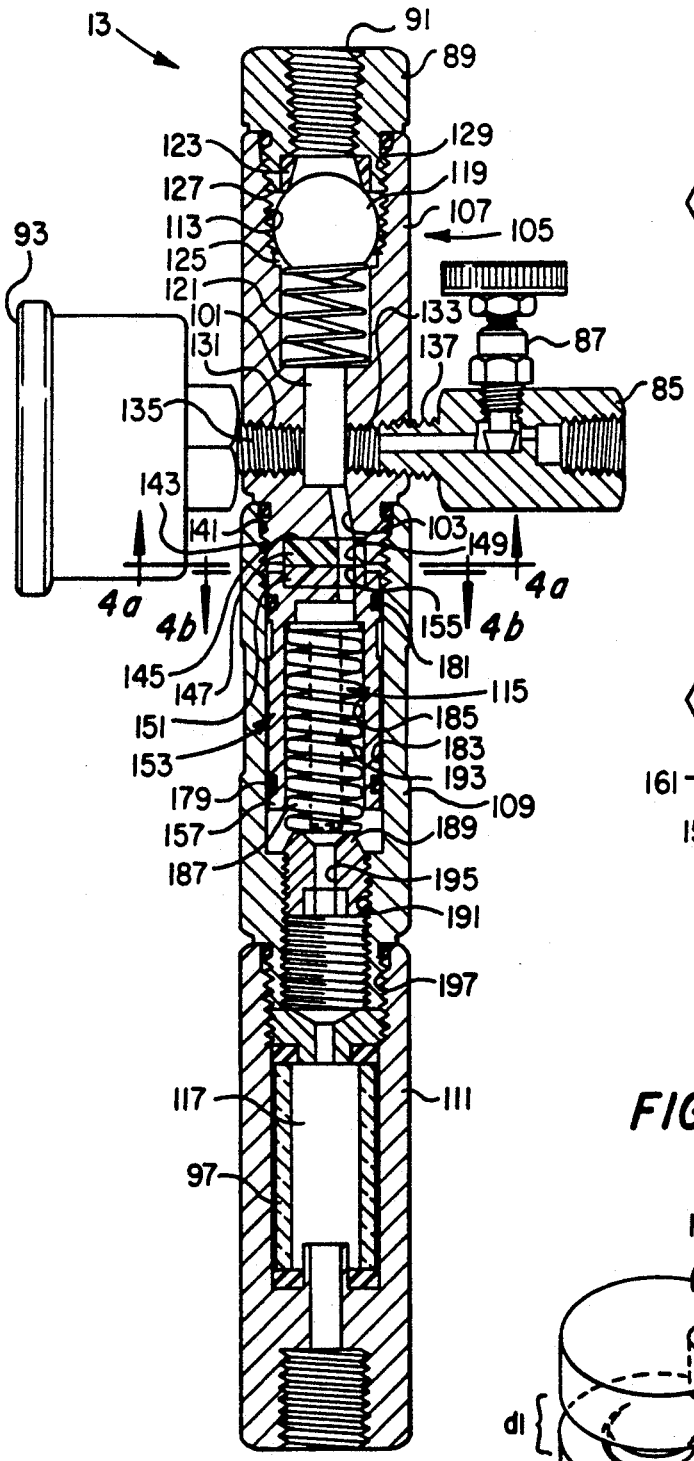
FIG. 3 is a partial longitudinal section view of the preferred slip stream device of the present invention.

The preferred slip stream device 13 of the present invention is still better shown in FIG. 3, which is a partial longitudinal section view. As shown therein, slip stream device 13 includes generally cylindrical housing 105 which is formed of three housings which are releasably coupled together, including: upper housing 107, middle housing 109, and lower housing 111. Upper housing 107 includes mixing chamber 101 and biased ball check valve 113. Middle housing 109 includes pressure-actuated debris removal means 115. Lower housing 111 includes viewable chamber 117, which is enclosed by cylindrical sight glass 97.

As stated above, upper housing 107 includes mixing chamber 101, and biased ball check valve 113. Valve cavity 125 is defined in the interior of upper housing 107, and includes internal threads 127 which engage external threads 129 of inlet connector 89. Inlet 91 for production fluid is centrally disposed within inlet connector 89, and is also threaded for coupling. Seat 123 is disposed in the lower end of inlet connector 89, and is adapted to sealingly engage ball 119. Ball 119 is biased upward within valve cavity 125 by spring 121.

Normally, pressure from production fluid which is routed into slip stream device 13 through inlet 91 will keep biased ball check valve 113 open by pressing ball 119 downward against spring 121. However, if pressure builds downstream within slip stream device 13 (for instance, in the case of a clog) pressure will be equalized across biased ball check valve 113, and ball 119 will be biased to seat against seat 123 to prevent production-enhancing chemicals which are continuously injected into mixing chamber 101 from flowing upstream of the diverted production fluids. Instead, pressure will then build within mixing chamber 101 of slip stream device 13 until the clog is blown through, clearing the fluid flow lines, or alternately until slip stream device 13 automatically readjusts as discussed below.

As shown, mixing chamber 101 includes inlet 91, which circulates production fluid past biased ball check valve 113, and outlet 103. In addition, mixing chamber 101 is in communication with gauge 93 through threaded passage 131. Mixing chamber 101 is also connected to sample valve 87 through passage 133. An externally threaded connector 135 couples mixing chamber 101 to gauge 93. Externally threaded sample valve connector 137 releasably couples sample valve 87 to mixing chamber 101.

Chemical inlet 139 (not shown in FIG. 3) is also in communication with mixing chamber 101, and allows the production-enhancing chemicals to flow from chemical injection inlet 81 into the interior of mixing chamber 101 to be mixed with production fluids which are diverted through slip stream device 13 at inlet 91. Mixing chamber 101 is also provided with an outlet 103 for the passage of the fluid mixture of production fluids and production-enhancing chemicals.

The lower end of upper housing 107 includes external threads 141 which are adapted for adjustably and releasably coupling with internal threads 143 at the upper end of middle housing 109. Disc-shaped cavity 145 is provided at the lower end of upper housing 107, and is adapted to receive and retain a first (or upper) choke member 147. Upper choke member 147 includes intake passage 149 which allows fluid to pass into choke member 151. Intake passage 149 is in alignment with outlet 103 of mixing chamber 101. In the preferred embodiment, upper choke member 147 is composed of a ceramic material.

Lower choke member 151 is disposed at the upper end of middle housing 109, and is carried at the upper end of sliding assembly 153 which is disposed interiorly of middle housing 109. Lower choke member 151 is preferably made of a ceramic material, and it includes exhaust port 155.

Together, upper and lower choke members 147, 151 define a flow control means which permits only a predetermined rate of flow of the fluid mixture of production fluid and production-enhancing chemical to exit from mixing chamber 101. In the preferred embodiment, upper and lower choke members 147, 151 are adjustable in radial position relative to one another to increase or decrease the rate of flow of the fluid mixture from mixing chamber 101. As shown in FIG. 3, lower choke member 151 is carried by sliding assembly 153. Sliding assembly 153 includes adjustment tube 157 which is the human-operable adjustment control 95, which is seen in perspective view in FIG. 2. By rotating adjustment tube 157 with a thumb and forefinger, the radial position of lower choke member 151 may be adjusted relative to upper choke member 147. As will be discussed below, this allows for a range of control over the flow rate of the fluid mixture which exits from mixing chamber 101 through upper and lower choke members 147, 151.

Figure 4A:
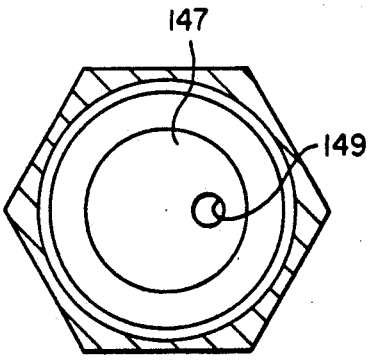
FIGS. 4*a* and 4*b* are cross-section views as seen respectively from the sections 4*a*—4*a* and 4*b*—4*b* of FIG. 3.
Figure 4B:
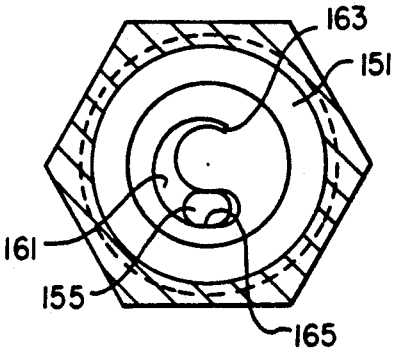

The operation of choke assembly 159, which includes upper and lower choke members 147, 151 is best understood with reference to FIGS. 4 and 6. FIGS. 4*a* and 4*b* are cross-section views as seen respectively from the sections 4*a*—4*a* and 4*b*—4*b* of FIG. 3. As shown in FIG. 4*a*, upper choke member 147 substantially obstructs the passage of fluid through slip stream device 13, with the exception of intake port 149 which does allow the passage of fluid downward through slip stream device 13. Lower choke member 151 likewise substantially obstructs the passage of fluid through slip stream device 13, but is equipped with exhaust port 155 which does allow the passage of fluid downward through slip stream device 13.

FIG. 4*b* reveals a feature which is not visible in the longitudinal section view of FIG. 3. Specifically, fluid flow channel 161 is formed in a ceramic material which comprises lower choke member 151, and communicates with exhaust port 155. In the preferred embodiment, fluid flow channel 161 is arcuate in shape, and extends between first end 163, and second 165. First end 161 is narrower and shallower than second end 165. Preferably, fluid flow channel 161 expands continuously in width from first end 163 to second end 165. In addition, fluid flow channel 161 also continuously increases in depth between first end 163 and second end 165. Finally, in the preferred embodiment, fluid flow channel 161 terminates at second end 165 into exhaust port 155.

In the preferred embodiment, upper and lower choke members 147, 151 are approximately one-eighth of an inch thick. Preferably, intake port 149 which extends through upper choke member 147 is one-eighth of an inch in diameter. Likewise, exhaust port 155 is one-eighth of an inch in diameter. In the preferred embodiment fluid flow channel 161 is arcuate and in the shape of a comet's tail. Fluid flow channel 161 extends from first end 163, where the depth and width of the fluid flow channel 161 is zero, to second end 165, where the depth and width of the fluid flow channel is one-eighth of an inch. Therefore, as stated above, fluid flow channel 161 continuously increases in width and depth between first end 163, and second end 165.

Figures 6A, 6B, 6C, 6D:
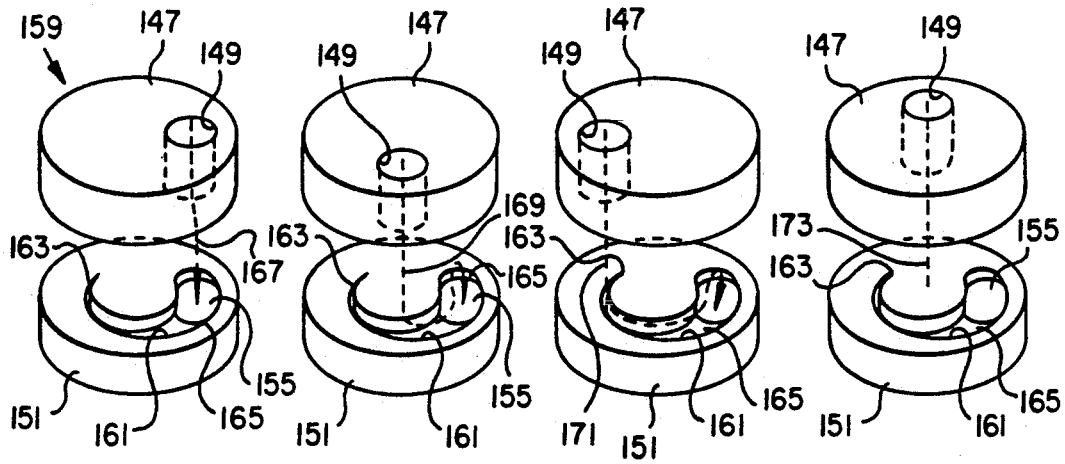
FIGS. 6*a*, 6*b*, 6*c*, and 6*d* are perspective views of the upper and lower choke member of the preferred slip stream device of the present invention in different rotational (or radial) positions relative to one another.

Fluid flow channel 161 is perhaps still better shown in FIG. 6. FIGS. 6*a* through 6*d* are perspective views of the upper and lower choke members 147, 151 of the preferred slip stream device 13 of the present invention in different rotational (or radial) positions relative to one another. For purposes of exposition, upper and lower choke members 147, 151 are shown spaced-apart axially; in fact, in use, upper and lower choke members 147, 151 are in substantial planar engagement. Also, for purposes of exposition, the fluid flow path through upper and lower choke members 147, 151 is graphically depicted in FIGS. 6*a* through 6*d* by fluid flow arrows 167, 169, 171, and 173.

As shown in FIG. 6*a*, when intake port 149 is substantially aligned with exhaust port 155, the fluid mixture flows from mixing chamber 101 in the direction of fluid flow arrow 167. As shown, the fluid will shoot straight down through intake port 149, and then directly into exhaust port 155. This fluid flow path 167 is easy to understand if one is to mentally compress together upper and lower choke members 147, 151.

In FIG. *6b*, upper and lower choke members 147, 151 are shown with intake port 149, and exhaust port 155 out of alignment. As shown, the fluid mixture from mixing chamber 101 is directed downward through intake port 149 and into fluid flow channel 161, which directs the fluid mixture in the direction of fluid flow arrow 169 to second end 165, where it is evacuated from the choke assembly 159 through exhaust port 155. The flow rate through the choke assembly 159 in the configuration shown in FIG. *6b* will be less than that shown in FIG. *6a*, since the region of fluid flow channel 161 which is aligned with intake port 149 of upper choke member 147 has substantially less fluid carrying capacity than exhaust port 155.

Choke assembly 159 is shown in yet another position in FIG. *6c*. As shown, upper choke member 147 is shown with intake port 149 disposed substantially at first end 163 of fluid flow channel 161. At this location, fluid flow channel 161 has its minimum fluid flow capacity, so the rate of flow of the fluid mixture through choke assembly 159 is still further reduced from that shown in FIG. *6b*. The fluid that is accepted by fluid flow channel 161 is directed through the channel in the direction of fluid flow arrow 171 to exhaust port 155.

As a final example, FIG. *6d* shows a configuration with intake port 149 aligned over a region of lower choke member 151 which does not include fluid flow channel 161. In this configuration, the flow of fluid is stopped, since no channel is provided to direct the fluid to exhaust port 155.

For purposes of exposition, upper and lower choke members 147, 151 are shown in FIGS. *6a* through *6d* in various positions relative to one another. The positioning of the intake and exhaust ports 149, 155 can be accomplished by rotating one or the other, or both, of upper and lower choke members 147, 151. However, in the preferred embodiment, as shown in FIG. 3, only lower choke member 151 is adjustable in radial position relative to upper choke member 147.

The progression of examples shown in FIG. 6 illustrates the flow control feature of the present invention. The preferred slip stream device 11 of the present invention is also equipped with a second adjustment which improves operation of the slip stream device substantially. In particular, it has been discovered that production fluids from oil and gas well 11 frequently include particles of debris which are carried upward to the surface through tubing 17. These pieces of debris can be small pieces of rubber or other materials from degraded surface or subsurface completion and production equipment. For example, small pieces of rubber can detach from stuffing box 53 (of FIG. 1) as sucker rod string 21 is reciprocated within oil and gas well 11.

Figure 5A:
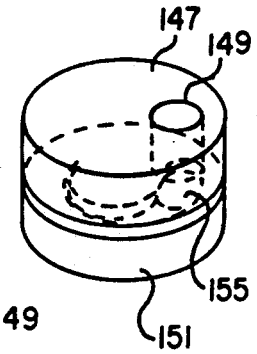
FIGS. 5*a* and 5*b* are perspective views of the upper and lower choke members of the preferred slip stream device of the present invention in different longitudinal (or axial) positions relative to one another.
Figure 5B:
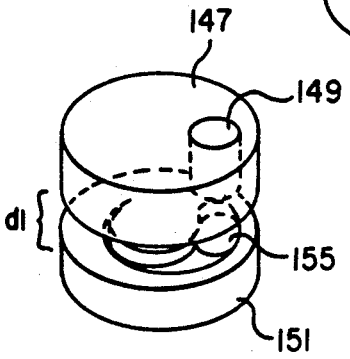
Figures 7A, 7B:
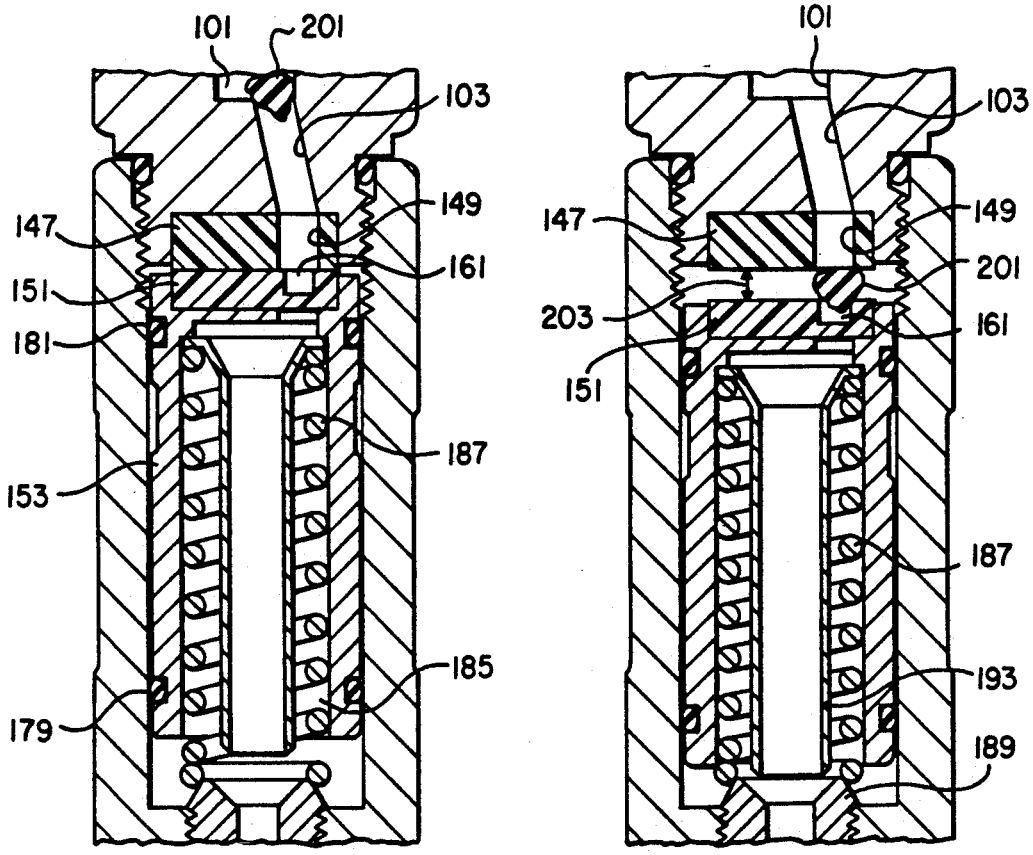
FIGS. 7*a* and 7*b* are longitudinal section views of a portion of the preferred slip stream device of the present invention with a clogging debris piece shown progressing through said slip stream device in time sequence order.

These debris particles are carried by production fluid and can become clogged within choke assembly 159 and impede or prevent the continuous injection of performance-enhancing chemicals into oil and gas well 11. Of course, the interference with the continual injection of performance-enhancing chemicals can result in a decline or cessation of production, which has a negative economic impact on the profitability of oil and gas well 11. Accordingly, the improved slip stream device 13 of the present invention is equipped with a clog control adjustment feature (which can also be considered as a "choke override" feature) which automatically operates to facilitate the removal of clogs from choke assembly 159. This clog control feature is best described with reference to FIGS. 3, 5, and 7.

Returning now to FIG. 3, as shown, sliding assembly 153 is carried within middle housing 109, but is not fixedly attached thereto. Sliding assembly 153 is, however, sealed at the interface with central bore 183 of middle housing 109 by O-ring seals 179, 181. Adjustment tube 157 of sliding assembly 153 is equipped with spring cavity 185 which receives spring 187, which operates to bias sliding assembly 153 upward within middle housing 109, so that lower choke member 151 is in interfacing relationship with upper choke member 147.

Externally threaded spring plug engages at internally threaded plug bore 191 at the lower end of middle housing 109. Spring plug 189 operates to hold spring 187 in a fixed position within spring cavity 185. Flow tube 193 extends centrally through spring 187, and is adapted for receiving fluid from exhaust port 155 of lower choke member 151, and directing it through spring 187, to prevent the lodging of debris in the coils of spring 187. Spring plug 189 is equipped with a central bore 195 which directs fluid downward into lower housing 111. The lower end of middle housing 109 is externally threaded for mating with internal threads 197 of the upper end of lower housing 111.

In operation, spring 187 operates to bias sliding assembly 153 upward, so that lower choke member 151 is interfacing relationship with upper choke member 147. If debris becomes lodged in choke assembly 159, pressure will begin to build-up within mixing chamber 101. This will cause ball 119 of biased ball check valve 113 to seat against seat 123 to prevent the backflow of fluids through tubing 17. However, pump 67 will continue to inject production-enhancing chemical 69 from chemical reservoir 27 into mixing chamber 101. Consequently, the pressure within mixing chamber 101 will continue to build-up, and a sizable pressure differential will develop across choke assembly 159. In the preferred embodiment, spring 187 is selected to provide two hundred pounds of force on sliding assembly 153. When a pressure differential of over two hundred pounds of force is developed across choke assembly 159, the differential will work against spring 187, and urge sliding assembly 153 downward until adjustment tube 157 seats against spring plug 189. This results in a separation of upper and lower choke members 147, 151, which is graphically depicted in simplified form in FIGS. *5a* and *5b*.

As shown in FIGS. *5a* and *5b*, the previously substantially interfacing upper and lower choke members 147, 151 are urged from an interfacing position shown in FIG. *5a* to a spaced-apart position like that shown in FIG. *5b*. Upon clogging of choke assembly 159 upper and lower choke members 147, 151 are separated by a predetermined distance d1. In the preferred embodiment, this distance is approximately one-eighth of an inch. This axial adjustment of the relative positions of upper and lower choke members 147, 151 operates to facilitate the passage of debris particles through the choke plates. This particularly true when intake port 149, and exhaust port 155 are offset so that intake port 149 feeds fluid into a region of limited flow capacity of fluid flow channel 161.

The clog control adjustment feature of the present invention is perhaps better represented graphically in FIGS. *7a* and *7b*. FIGS. *7a* and *7b* are longitudinal section views of the portion of the preferred slip stream device 13 of the present invention with the clogging debris piece shown progressing through slip stream device in time sequence order. As shown in FIG. *7a*, debris 201 exits from mixing chamber 101 when a sufficient pressure level is developed within mixing chamber 101 to expel debris 201. Debris exits from mixing chamber 101 through outlet 103, and is directed to intake port 149 of upper choke member 147. In the preferred embodiment, outlet 103 of mixing chamber 101 and intake port 149 of upper choke member 147 have substantially the same flow capacity, and dimensions. A problem arises at the interface of upper choke member 147 and lower choke member 151, particularly if intake port 149 is directing fluid into fluid flow channel 161 which has a lesser fluid flow capacity than intake port 149.

When intake port 149 of upper choke member 147 feeds into a region of diminished fluid flow capacity of fluid flow channel 161, debris 201 is likely to become stuck at the interface of upper and lower choke members 147, 151, and impede or prevent the flow of the fluid mixture of production fluid and production-enhancing chemicals through slip stream device 13. As discussed above, when this occurs pump 67 of FIG. 1, continues pumping performance-enhancing chemicals 69 into mixing chamber 101 of slip stream device 13. As a consequence, biased ball check valve 113 will close, but pump 67 will continue pumping production-enhancing chemicals into mixing chamber 101. When pressure within mixing chamber 101 exceeds two hundred pounds per square inch, upper and lower choke members 147, 151 are urged apart from the interfacing position shown in FIG. *7a* to the spaced-apart position shown in FIG. *7b*. Of course, the increase in spacing is gradual, and upper and lower choke members 147, 151 will only separate enough to allow the passage of the clogging debris.

This change in position occurs because spring 187 is compressed downward within spring cavity 185, and sliding assembly 153 is allowed to move downward until flow is resumed.

The result is that a clearance 203 is provided between upper and lower choke members 147, 151 of a predetermined distance. In a preferred embodiment, this distance is approximately one-eighth of an inch. This clearance facilitates the passage of debris 201 through fluid flow channel 161, and allows debris 201 to be directed along the length of fluid flow channel 161 until it reaches second end 165 of fluid flow channel 161. Of course, second end 165 of fluid flow channel 161 communicates with exhaust port 165 of lower choke member 151. Without such an automatic separation of upper and lower choke members 147, 151, debris 201 could become permanently lodged between upper and lower choke members 147, 151, impeding the continuous injection of performance-enhancing chemicals into oil and gas well 11.

If viewed broadly, slip stream device 13 of the present invention is a device which continuously adds chemicals to a producing oil and gas well 11, which has production fluid which is moved upwardly through the well through tubing. The slip stream device 13 includes a mixing chamber 101 which has an inlet 91, and an outlet 103. A means is provided for diverting the flow of production fluid from oil and gas well 11, and directing the flow of production fluid to the inlet 91 of mixing chamber 101. A means is provided, preferably including pump 67 and reservoir 27, for admitting an amount of chemical into mixing chamber 101. Production fluid and the chemical are mixed together into a "fluid mixture" within mixing chamber 101, and exhausted through outlet 103.

A flow control means is provided, in fluid communication with outlet 103 of mixing chamber 101. The flow control means permits only a predetermined flow rate of the fluid mixture from mixing chamber 101. Preferably, the flow control device comprises a choke including a plurality of choke members defining at least one intake port and at least one exhaust port, wherein the relative positions of the plurality of choke members establishes a flow rate for the flow mixture through flow control means.

In one preferred embodiment, the flow control means includes axially aligned upper and lower choke plate members 147, 151 with at least one intake port 149 in the upper choke plate 147 and at least one exhaust port 155 in the lower choke plate 151. At least one flow channel 161 is provided between the upper and lower choke plate members 147, 151, and includes regions of differing flow capacity. Preferably, but not necessarily, flow channel 161 is formed in the lower choke plate member 151, and communicates with the at least one exhaust port 155 of the lower choke member 151.

Preferably, the intake port of the upper choke plate member 157 is alignable with a selected region of the flow channel 161 of the lower choke plate member 151 to vary the flow rate of the fluid mixture through the flow control means.

An adjustment control allows the operator to adjust the radial position of the upper and lower choke plate members 147, 151, to allow adjustment of the relative position of intake port, or ports, 149, the exhaust port, or ports, 155, and the flow channel, or channels, 161.

In the preferred embodiment, the slip stream device 13 of the present invention includes a second adjustment means, which is responsive to pressure within mixing chamber 101, for automatically adjusting the flow control means to allow passage of debris from the flow control means which would impede the flow of fluid mixture from mixing chamber 101. Preferably, the second adjustment means operates to automatically adjust the relative axial placement of the first and second choke members 147, 151 in response to pressure within mixing chamber 101, to facilitate passage of debris 201 through the flow control means.

The slip stream device 13 of the present invention is operable at a plurality of operating modes. In an obstructed flow mode of operation, the fluid mixture flows through the flow control means at a predetermined flow rate, which is operator-established by an adjustment control. In an unobstructed flow mode of operation, debris 201 clogs the flow control means, and at least restricts flow of fluid mixture from mixing chamber 101, causing build-up of pressure within the mixing chamber. In a clog-removal mode of operation, pressure build-up within the mixing chamber 101 causes the second adjustment means to automatically adjust the flow control means to facilitate passage of debris through the flow control means.

FIG. *8a* depicts an alternative placement of slip stream device 13 of the present invention relative to oil and gas well 11. In FIG. *8a*, the numerals of FIG. 1 are used to identify the various components depicted. As shown, slip stream device 13 is coupled to oil flow conduit 47, for receiving production fluids. Slip stream device 13 is coupled to pump 67 through injection line 29. The output of slip stream device 13 is coupled through exhaust line 31 to feedback conduit 61.

Figure 8C:
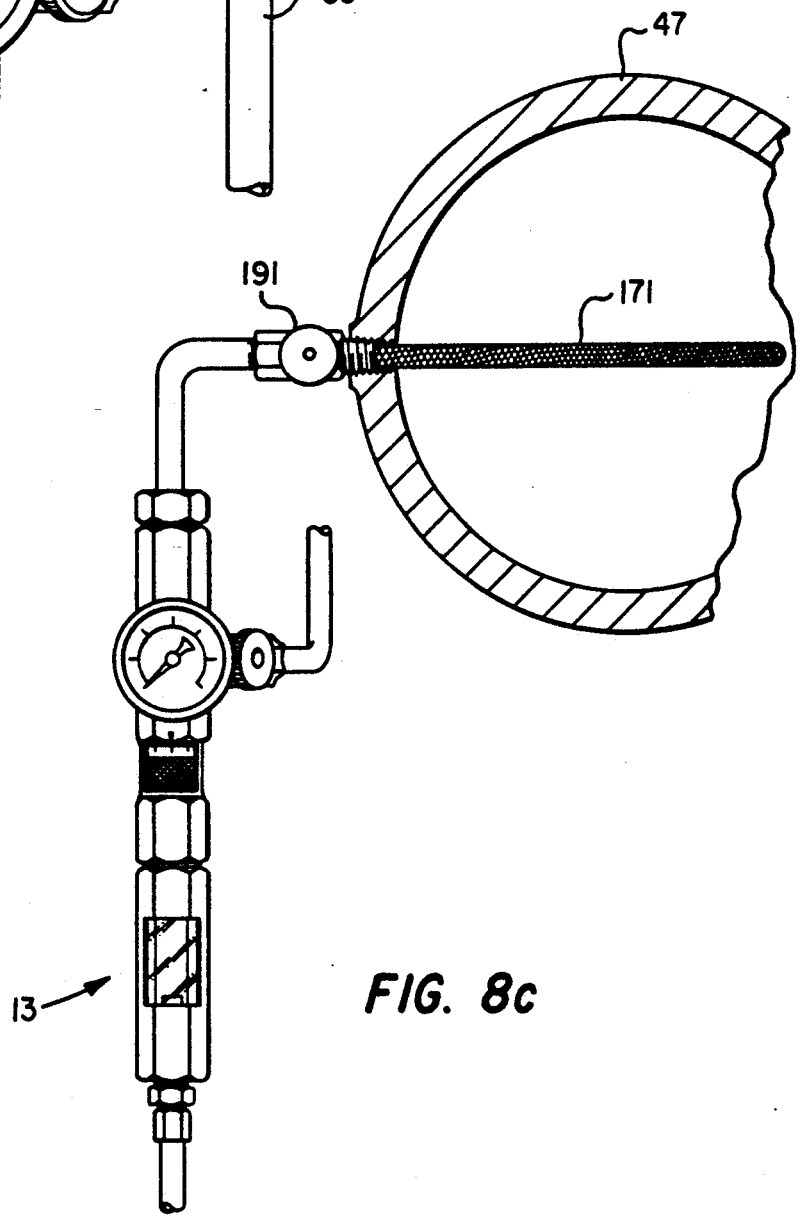
FIGS. 8*a*, 8*b*, and 8*c* depict an alternative placement of the improved slip stream device of the present invention.
Figure 8A:
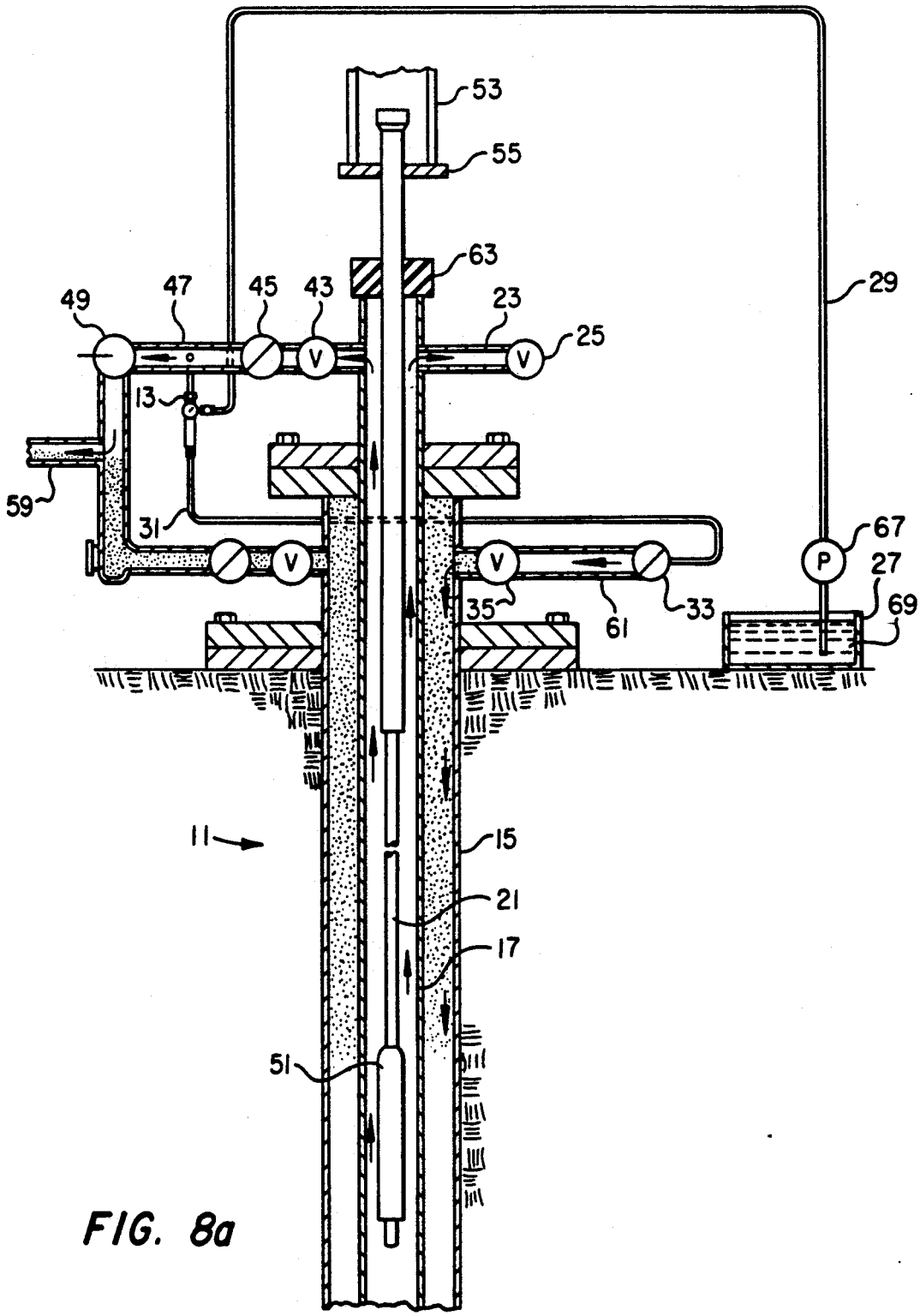
Figure 8B:
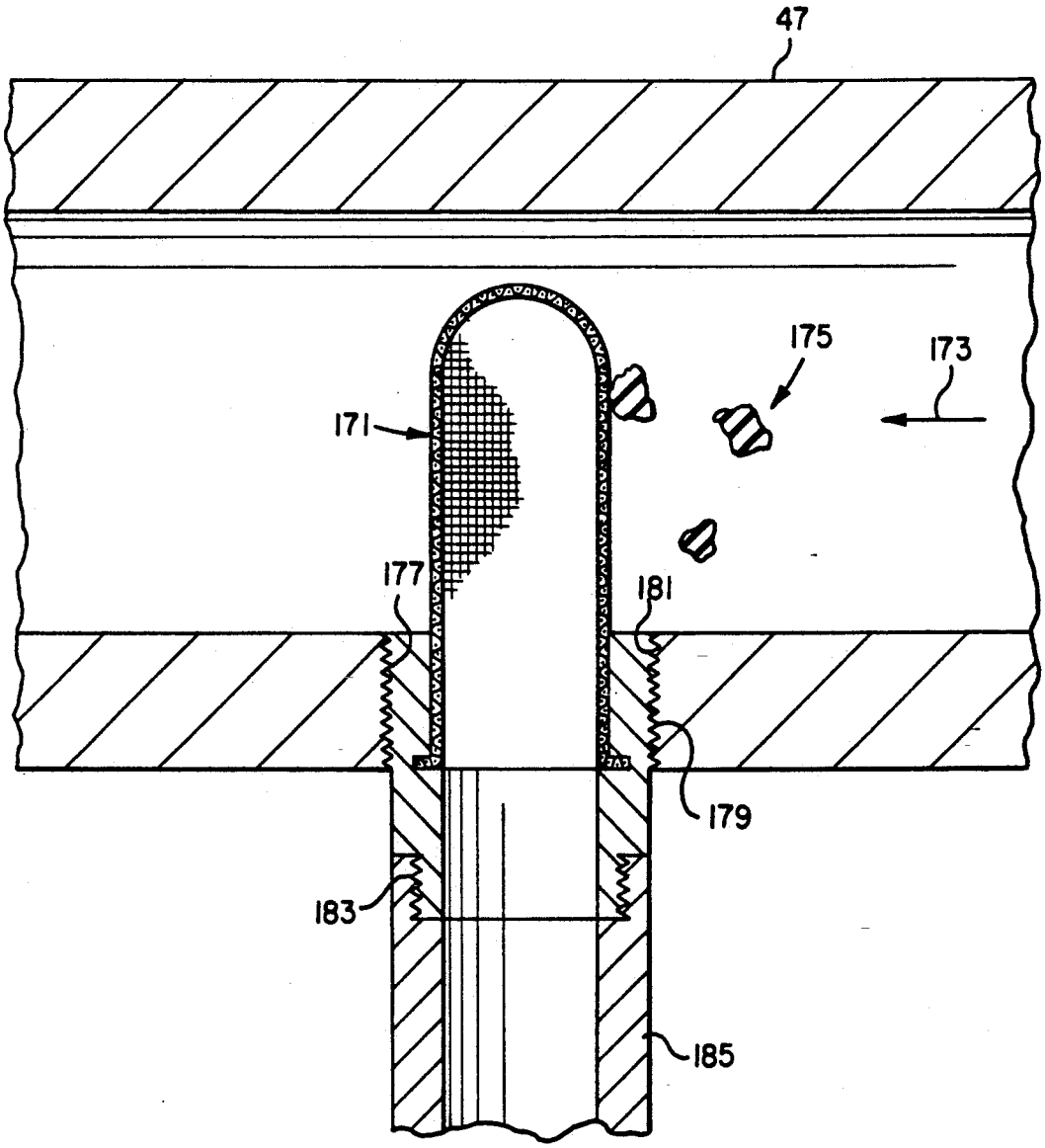

When slip stream device 13 is placed in the configuration of FIG. 8*a*, the preferred slip stream device 13 of the present invention may include a self-cleaning filter element, as shown in FIG. 8*b*.

In FIG. 8*b*, oil flow conduit 47 is shown in longitudinal section. Filter element 171 is provided therein, and is exposed to the continuous flow of production fluids represented by arrow 173. Preferably, filter 171 is composed of a metal or fabric mesh which allows the passage of production fluid 173 into slip stream device 13, but which prevents the passage of debris 175 inward into slip stream device 13. Preferably, filter 171 is secured in place relative to oil flow conduit 47 by collar 177, which is secured by threads 179 to port 181 within oil flow conduit 47. Collar 177 is also coupled by threads 183 to flow conduit 185 which operates to direct production fluid 173 to the inlet of the mixing chamber of slip stream device 13 of the present invention. Filter 171 is continually exposed to the flow of production fluid 173, and thus particles of debris 175, which are disposed at the outer surface of filter 171, are eventually washed downstream. Preferably, filter 171 is formed of a flexible material which is corrosion resistant, and thus can sway in the flow of production fluid 173 to further enhance the self-cleaning action of filter in response to production fluids 173. Filter element 171 is shown more realistically in FIG. 8*c*. As shown, valve 191 is provided to allow slip stream device 13 to be removed from oil flow conduit 47.

While the invention has been shown in only one of its forms, it is not thus limited but is susceptible to various changes and modifications without departing from the spirit thereof.

What is claimed is:

1. An apparatus for continually adding chemicals to a producing oil and gas well, wherein production fluid is moved upwardly within said well through a tubing, comprising:

a mixing chamber having an inlet and an outlet;

means for diverting a flow of production fluid from said oil and gas well and directing said flow of production fluid to said inlet of said mixing chamber;

means for admitting an amount of chemical into said mixing chamber;

wherein a fluid mixture of said production fluid and said chemical is exhausted from said mixing chamber through said outlet;

flow control means, in fluid communication with said outlet of said mixing chamber, for permitting only a predetermined flow rate of said fluid mixture from said mixing chamber;

said flow control means including a choke having a plurality of choke members defining at least one intake port and at least one exhaust port, wherein relative positions of said plurality of choke members establishes a flow rate for said fluid mixture through said flow control means;

adjustment means for adjusting said predetermined flow rate of said fluid mixture from said mixing chamber to selectively adjust said predetermined flow rate;

means for conveying said fluid mixture from said outlet into said oil and gas well; and whereby said fluid mixture flushes downwardly into said oil and gas well to be pumped upwardly through said tubing.

2. An apparatus according to claim 1, further comprising a pressure responsive valve means communicating with said inlet of said mixing chamber for closing said inlet when a pressure within said mixing chamber exceeds a predetermined value.

3. An apparatus according to claim 1, further comprising a pressure responsive valve means communicating with said inlet of said mixing chamber which includes a ball valve which seats to close said inlet of said mixing chamber when a pressure within said mixing chamber exceeds a predetermined value.

4. An apparatus according to claim 1, for use with a producing oil and gas well wherein production fluid is moved upwardly within said well through said tubing which is centrally disposed within a casing which at least in-part lines said oil and gas well, wherein said fluid mixture of said production fluid and said chemical is exhausted from said mixing chamber into said oil and gas well between said tubing and said casing.

5. An apparatus according to claim 1, further comprising a pressure gauge means communicating with said mixture chamber for registering a pressure therewithin.

6. An apparatus according to claim 1, further comprising a sight glass coupled to said means for conveying to allow visual inspection of passage of said fluid mixture.

7. An apparatus according to claim 1, further comprising bleed valve means in communication with said mixing chamber for sampling said fluid mixture.

8. An apparatus according to claim 1, wherein said mixing chamber is disposed exteriorly of said oil and gas well.

9. An apparatus according to claim 1, wherein said adjustment means is human-operable and disposed on the exterior of said apparatus.

10. An apparatus according to claim 1, wherein relative rotation between said plurality of choke members establishes a flow rate for said fluid mixture through said flow control means for selectively adjusting said predetermined flow rate.

11. An apparatus according to claim 1, wherein said flow control means comprises said choke having a first and second choke members, with said at least one intake port in said first choke member and said at least one exhaust port in said second choke member, wherein relative placement of said first and second choke members establishes said flow rate for said fluid mixture through said flow control means for selectively adjusting said predetermined flow rate.

12. An apparatus according to claim 1, wherein said flow control means comprises said choke having a first and second choke members, with said at least one intake port in said first choke member and said at least one exhaust port in said second choke member, wherein relative radial placement of said first and second choke members establishes said flow rate for said fluid mixture through said flow control means for selectively adjusting said predetermined flow rate.

13. An apparatus according to claim 1, wherein said flow control means comprises said choke having an upper and lower choke plates, with said at least one intake port in said upper plate and said at least one exhaust port in said lower plate, and wherein relative placement of said at least one intake port and said at least one exhaust port of said upper and lower choke plates alters said flow rate of said fluid mixture through said flow control means for selectively adjusting said predetermined flow rate.

14. An apparatus according to claim 1, wherein said flow control means comprises said choke including said plurality of choke members defining said at least one intake port and said at least one exhaust port, wherein relative placement of said plurality of choke members establishes said flow rate for said fluid mixture through said flow control means and wherein said adjustment means allows for relative repositioning of said plurality of choke members to alter said flow rate of said fluid mixture through said flow control means for selectively adjusting said predetermined flow rate.

15. An apparatus according to claim 1, wherein said flow control means comprises said choke having a first and second choke members, with said at least one intake port in said first choke member and said at least one exhaust port in said second choke member, wherein relative placement of said first and second choke members establishes said flow rate for said fluid mixture through said flow control means, and wherein said adjustment means allows for repositioning of said first and second choke members relative to one another to alter said flow rate of said fluid mixture through said flow control means for selectively adjusting said predetermined flow rate.

16. An apparatus according to claim 1, wherein said flow control means comprises said choke having a first and second choke members, with said at least one intake port in said first choke member and said at least one exhaust port in said second choke member, wherein relative radial placement of said first and second choke members establishes said flow rate for said fluid mixture through said flow control means, and wherein said adjustment means allows for radial repositioning of said first and second choke members relative to one another to alter said flow rate of said fluid mixture through said flow control means for selectively adjusting said predetermined flow rate.

17. An apparatus according to claim 1, wherein said flow control means comprises said choke including said plurality of choke members defining said at least one intake port and said at least one exhaust port, wherein relative placement of said plurality of choke members establishes said flow rate for said fluid mixture through said flow control means, which at least in part determines said predetermined flow rate, and wherein said choke further includes means for directing fluid flow between said at least one intake port and said at least one exhaust port.

18. An apparatus according to claim 1, wherein said flow control means comprises said choke which includes said plurality of choke members defining said at least one intake port and said at least one exhaust port, wherein relative placement of said plurality of choke members establishes said flow rate for said fluid mixture through said flow control means between said at least one intake port and said at least one exhaust port, and wherein said plurality of choke members further define a fluid flow channel with variable fluid flow capacity which is positionable relative to at least one of said at least one intake port and said at least one exhaust port to vary said flow rate of said fluid mixture through said fluid control means for selectively adjusting said predetermined flow rate.

19. An apparatus according to claim 1, wherein said fluid control means comprises:

axially aligned upper and lower choke plates with said at least one intake port in said upper choke plate and said at least one exhaust port in said lower choke plate;

at least one flow channel including regions of differing flow capacity formed in said lower choke plate and communicating with said at least one exhaust port of said lower choke plate; and wherein said intake port of said upper choke plate is alignable with a selected region of said flow channel of said lower choke plate to vary said flow rate of said fluid mixture through said flow control means for selectively adjusting said predetermined flow rate.

20. An apparatus according to claim 1, wherein said flow control means comprises:

axially aligned upper and lower choke plates with said at least one intake port in said upper choke plate and said at least one exhaust port in said lower choke plate;

at least one flow channel, including regions of differing flow capacity, formed in said lower choke plate and communicating with said at least one exhaust port of said lower choke plate;

wherein said intake port of said upper choke plate is alignable with a selected region of said flow channel of said lower choke plate to vary said flow rate of said fluid mixture through said flow control means; and wherein said adjustment means operates to allow adjustment of a radial position of said upper and lower choke plate, and to allow adjustment of the relative position of:

(a) said at least one intake port;

(b) said at least one exhaust port; and (c) said at least one flow channel;

to facilitate adjustment of said flow rate of said fluid mixture through said flow control means for selectively adjusting said predetermined flow rate.

21. An apparatus according to claim 1, wherein said flow control means comprises:

axially aligned upper and lower choke plates with an intake port in said upper choke plate and an exhaust port in said lower choke plate;

a flow channel formed in the lower choke plate and communicating with the exhaust port, said flow channel varying in width and depth to define regions of differing flow capacity;

wherein said intake port of said upper choke plate is alignable with a selected region of said flow channel of said lower choke plate to vary said flow rate of said fluid mixture through said flow control means; and wherein said adjustment means allows adjustment of said relative position of:

(a) said intake port;

(b) said exhaust port; and (c) said flow channel;

to facilitate adjustment of said flow rate of said fluid mixture through said flow control means for selectively adjusting said predetermined flow rate.

22. An apparatus according to claim 1, wherein said flow control means comprises:

axially aligned upper and lower choke plates with an intake port in said upper choke plate and an exhaust port in said lower choke plate;

a flow channel formed in said lower choke plate and communicating with said exhaust port, said flow channel being arcuate in shape and varying continuously in width and depth along its entire length to define regions of differing flow capacity;

wherein said intake port of said upper choke plate is alignable with a selected region of said flow channel of said lower choke plate to vary said flow rate of said fluid mixture through said flow control means; and wherein said adjustment means allows adjustment of said relative position of:

(a) said intake port;

(b) said exhaust port; and (c) said flow channel;

to facilitate adjustment of said flow rate of said fluid mixture through said flow control means for selectively adjusting said predetermined flow rate.

23. An apparatus according to claim 1, wherein said flow control means comprises:

axially aligned upper and lower choke plates with an intake port in said upper choke plate and an exhaust port in said lower choke plate;

a flow channel formed in said lower choke plate, having first and second ends, with said first end being narrower and shallower than said second end and with said second end in communication with said exhaust port, said flow channel varying continuously in width and depth along its entire length to define regions of differing flow capacity;

wherein said intake port of said upper choke plate is alignable with a selected region of said flow channel of said lower choke plate to vary said flow rate of said fluid mixture through said flow control means; and wherein said adjustment means allows adjustment of said relative position of:

(a) said intake port;

(b) said exhaust port; and (c) said flow channel;

to facilitate adjustment of rates of flow of said fluid mixture through said flow control means for selectively adjusting said predetermined flow rate.

24. An apparatus according to claim 1, further comprising a filter element coupled upstream of said inlet for minimizing the passage of debris into said mixing chamber.

25. An apparatus according to claim 24, wherein said filter element is continually exposed to and continually cleansed by a passage of a production fluid within a production flow conduit.

26. An apparatus for continually adding chemicals to a producing oil and gas well, wherein production fluid is moved upwardly within said oil and gas well through a tubing, and wherein debris is carried in said production fluid, comprising:

a mixing chamber having an inlet and an outlet;

means for diverting a flow of production fluid from said oil and gas well and directing said flow of production fluid to said inlet of said mixing chamber;

means for admitting an amount of chemical into said mixing chamber;

wherein a fluid mixture of said production fluid and said chemical is exhausted from said mixing chamber through said outlet;

flow control means, in fluid communication with said outlet of said mixing chamber, for permitting only a predetermined flow rate of said fluid mixture from said mixing chamber;

first adjustment means for selectively adjusting said predetermined flow rate of said fluid mixture through said mixing chamber;

second adjustment means, responsive to a pressure within said mixing chamber, for automatically adjusting said flow control means to allow passage of debris through said flow control means which would impede the flow of said fluid mixture through said mixing chamber;

means for conveying said fluid mixture from said outlet into said oil and gas well; and whereby said fluid mixture flushes downwardly into said oil and gas well to be pumped upwardly through said tubing.

27. An apparatus according to claim 26, further comprising pressure responsive valve means communicating with said inlet of said mixing chamber for closing said inlet when pressure within said mixing chamber exceeds a predetermined value.

28. An apparatus according to claim 26, further comprising pressure responsive valve means communicating with said inlet of said mixing chamber which includes a ball valve which seats to close said inlet of said mixing chamber when said pressure within said mixing chamber exceeds a predetermined value.

29. An apparatus according to claim 26, for use with a producing oil and gas well wherein production fluid is moved upwardly within said well through said tubing which is centrally disposed within a casing which at least in-part lines said oil and gas well, wherein said fluid mixture of said production fluid and said chemical is exhausted from said mixing chamber into said oil and gas well between said tubing and said casing.

30. An apparatus according to claim 26, further comprising a filter element coupled upstream of said inlet for minimizing the passage of debris into said mixing chamber.

31. An apparatus according to claim 26, further comprising a sight glass coupled to said means for conveying to allow visual inspection of passage of said fluid mixture.

32. An apparatus according to claim 26, further comprising bleed valve means in communication with said mixing chamber for sampling said fluid mixture.

33. An apparatus according to claim 26, wherein said mixing chamber is disposed exteriorly of said oil and gas well.

34. An apparatus according to claim 26, wherein said first adjustment means is human-operable and disposed on the exterior of said apparatus.

35. An apparatus according to claim 26, wherein said flow control means defines a fluid passageway which is narrower than said mixing chamber for restricting said fluid mixture flowing therethrough to selectively adjust said predetermined flow rate.

36. An apparatus according to claim 26, wherein said flow control means comprises a choke including a plurality of choke members defining at least one intake port and at least one exhaust port, wherein the relative positions of said plurality of choke members establishes a flow rate for said fluid mixture through said flow control means, and wherein said second adjustment means operates to automatically reposition said plurality of choke members when said pressure within said mixing chamber substantially reaches a predetermined pressure level.

37. An apparatus according to claim 26, wherein said flow control means comprises a choke having a first and second choke members, with at least one intake port in said first choke member and at least one exhaust port in said second choke member, wherein relative radial placement of said first and second choke members establishes a flow rate for said fluid mixture through said flow control means for selectively adjusting said predetermined flow rate, and wherein said second adjustment means operates to automatically adjust the relative axial placement of said first and second choke members to facilitate passage of debris through said flow control means.

38. An apparatus according to claim 26, wherein said flow control means comprises a choke having upper and lower choke plates, with at least one intake port in said upper plate and at least one exhaust port in said lower plate, and wherein relative radial placement of said at least one intake port and said at least one exhaust port of said upper and lower choke plates alters a flow capacity of said flow control means, and wherein said second adjustment means operates to automatically adjust a relative axial placement of said upper and lower choke plates to provide a clearance therebetween to facilitate passage of debris through said flow control means.

39. An apparatus according to claim 26, wherein said flow control means comprises a choke having first and second choke members, with at least one intake port in said first choke member and at least one exhaust port in said second choke member, wherein relative radial placement of said first and second choke members establishes a flow rate for said fluid mixture through said flow control means, wherein said first adjustment means allows for radial repositioning of said first and second choke members relative to one another to alter said flow rate of said fluid mixture through said flow control means, and wherein said second adjustment means automatically adjusts a relative axial placement of said first and second choke members in response to said pressure within said mixing chamber to facilitate passage of debris through said flow control means.

40. An apparatus according to claim 26, wherein said flow control means comprises a choke which includes a plurality of choke members defining at least one intake port and at least one exhaust port, wherein relative placement of said plurality of choke members establishes a flow rate for said fluid mixture through said flow control means between said at least one intake port and said at least one exhaust port, and wherein said plurality of choke members further define a fluid flow channel with variable fluid flow capacity which is positionable, with said first adjustment means, relative to at least one of said at least one intake port and said at least one exhaust port to vary said flow rate of said fluid mixture through said fluid control means, and wherein said second adjustment means operates to automatically axially reposition said plurality of choke members when said flow control means becomes clogged with debris to facilitate passage of said debris from said flow control means.

41. An apparatus according to claim 26, wherein said fluid control means comprises:

axially aligned upper and lower choke plates with at least one intake port in said upper choke plate and at least one exhaust port in said lower choke plate;

at least one flow channel including regions of differing flow capacity formed in said lower choke plate and communicating with said at least one exhaust port of said lower choke plate;

wherein said intake port of said upper choke plate is alignable, with said first adjustment means, with a selected region of said flow channel of said lower choke plate to vary a flow rate of said fluid mixture through said flow control means; and wherein said upper and lower choke plates are automatically axially alignable with said second adjustment means.

42. An apparatus according to claim 26, wherein said flow control means comprises:

axially aligned upper and lower choke plates with at least one intake port in said upper choke plate and at least one exhaust port in said lower choke plate;

at least one flow channel, including regions of differing flow capacity, formed in said lower choke plate and communicating with said at least one exhaust port of said lower choke plate;

wherein said intake port of said upper choke plate is alignable with a selected region of said flow channel of said lower choke plate to vary a flow rate of said fluid mixture through said flow control means;

wherein said first adjustment means operates to allow adjustment of the axial position of said upper and lower choke plates, and to allow adjustment of the relative position of:

(a) said at least one intake port;

(b) said at least one exhaust port; and (c) said at least one flow channel;

to facilitate adjustment of rates of flow of said fluid mixture through said flow control means; and wherein said second adjustment means operates to automatically axially adjust the position of said upper and lower choke plates to facilitate passage of debris through said flow control means in response to build-up of pressure within said mixing chamber.

43. An apparatus for continually adding chemicals to a producing oil and gas well, wherein production fluid is moved upwardly within said well through a tubing, and wherein debris is carried in said production fluid, comprising:

a mixing chamber having an inlet and an outlet;

means for diverting a flow of production fluid from said oil and gas well and directing said flow of production fluid to said inlet of said mixing chamber;

means for admitting an amount of chemical into said mixing chamber;

wherein a fluid mixture of said production fluid and said chemical is exhausted from said mixing chamber through said outlet;

flow control means, in fluid communication with said outlet of said mixing chamber, for permitting only a predetermined flow rate of said fluid mixture from said mixing chamber;

said flow control means including a plurality of choke members defining at least one intake port and at least one exhaust port, wherein relative placement of said plurality of choke members establishes a flow rate for said fluid mixture through said flow control means;

first adjustment means for adjusting said flow rate of said fluid mixture through said flow control means to selectively adjust said predetermined flow rate of said mixture flowing from said mixing chamber;

second adjustment means, responsive to pressure within said mixing chamber, for automatically adjusting a position of said plurality of choke members relative to one another to allow passage of debris which clogs said flow control means and restricts said predetermined flow of said fluid mixture from said outlet of said mixing chamber;

means for conveying said fluid mixture from said outlet into said oil and gas well; and whereby said fluid mixture flushes downwardly into said oil and gas well to be pumped upwardly through said tubing.

44. An apparatus according to claim 43, wherein said flow control means further includes a clearance which is defined at least in-part by said plurality of choke members, which is adjustable in size by operation of said second adjustment means.

45. An apparatus according to claim 43, wherein said flow control means further includes a clearance which is defined at least in-part by said plurality of choke members, and wherein said choke members are biased together to define a first clearance size for a normal flow mode of operation, but which are urged apart to a second clearance size by build-up of pressure within said mixing chamber during a clog removal mode of operation with debris blocking said intake port of said flow control means, wherein, with said clearance in said second clearance size, debris is more easily passed through said flow control means.

46. An apparatus for continually adding chemicals to a producing oil and gas well, wherein production fluid is moved upwardly within said oil and gas well through a tubing, and wherein debris is carried in said production fluid, comprising:

a mixing chamber having an inlet and an outlet;

means for diverting a flow of production fluid from said oil and gas well and directing said flow of production fluid to said inlet of said mixing chamber;

means for continually admitting an amount of chemical into said mixing chamber;

wherein a fluid mixture of said production fluid and said chemical is exhausted from said mixing chamber through said outlet;

flow control means, in fluid communication with said outlet of said mixing chamber, for permitting only a predetermined flow rate of said fluid mixture through said mixing chamber;

first adjustment means for selectively adjusting said predetermined flow rate of said fluid mixture through said mixing chamber;

second adjustment means for adjusting said flow control means to allow passage of debris through said flow control means;

wherein said flow control means is operable in a plurality of operating modes, including:

an unobstructed flow mode of operation, wherein said fluid mixture flows through said flow control means at said predetermined flow rate which is operator-established by said first adjustment means;

an obstructed flow mode of operation, wherein said debris clogs said flow control means and at least restricts flow of said fluid mixture from said mixing chamber causing build-up of a pressure within said mixing chamber;

a clog-removal mode of operation, wherein pressure build-up within said mixing chamber causes said second adjustment means to automatically adjust said flow control means to facilitate passage of debris through said flow control means;

means for conveying said fluid mixture from said outlet into said oil and gas well; and whereby said fluid mixture flushes downwardly into said oil and gas well to be pumped upwardly through said tubing.

47. An apparatus according to claim 46, further comprising:

pressure responsive valve means communicating with said inlet of said mixing chamber for closing said inlet of said mixing chamber when said pressure within said mixing chamber exceeds a predetermined value; and wherein, during said obstructed flow mode of operation, said predetermined pressure value is exceeded causing said pressure responsive valve means to close said inlet of said mixing chamber, and said means for continually admitting admits chemical into said mixing chamber causing a build-up of said pressure therewithin.

48. An apparatus according to claim 46, wherein, during said clog-removal mode of operation, said second adjustment means operates to automatically and temporarily adjust said flow control means to facilitate passage of debris through said flow control means, and wherein, after passage of said debris through said flow control means, said flow control means returns to an unobstructed flow mode of operation.

49. An apparatus according to claim 46, wherein:

said flow control means comprises a plurality of choke members defining at least one intake port and at least one exhaust port, wherein relative radial placement of said plurality of choke members by said first adjustment means establishes a flow rate for said fluid mixture through said flow control means; and wherein, during said clog-removal mode of operation, said pressure build-up within said mixing chamber causes said second adjustment means to automatically adjust said plurality of choke members in axial position to facilitate passage of said debris through said flow control means.

50. A method of continually adding chemicals to a producing oil and gas well, wherein production fluid is moved upwardly within said oil and gas well through a tubing, and wherein debris is carried in said production fluid, comprising:

providing a mixing chamber with an inlet and an outlet;

diverting a predetermined amount of production fluid from said tubing into said inlet of said mixing chamber;

adding a predetermined flow of chemical to said mixing chamber, which mixes with said production fluid to form a fluid mixture;

providing a choke assembly with a choke inlet and a choke outlet, in communication with said outlet of said mixing chamber;

choking said fluid mixture after it passes through said outlet of said mixing chamber;

detecting obstruction of said choke assembly by said debris;

automatically adjusting said choke assembly in response to detected clogging; and conveying said fluid mixture and debris into said oil and gas well.

51. A method of continually adding chemicals to a producing oil and gas well according to claim 50, further comprising:

further providing said choke assembly with an adjustment control for adjustment of rates of flow of said fluid mixture through said choke assembly; and adjusting, with said adjustment control, said rate of flow of said fluid mixture through said choke assembly and into said oil and gas well.

52. A method of continually adding chemicals to a producing oil and gas well, wherein production fluid is moved upwardly within said oil and gas well through a tubing, and wherein debris is carried in said production fluid, comprising:

providing a mixing chamber with an inlet and an outlet;

diverting a predetermined amount of production fluid from said tubing into said inlet of said mixing chamber;

adding a predetermined flow of chemical to said mixing chamber, which mixes with said production fluid to form a fluid mixture;

providing a choke assembly with a choke inlet and a choke outlet, and an adjustment control for adjustment of rates of flow of said fluid mixture through said choke assembly;

choking said fluid mixture with said choke assembly after it passes through said outlet of said mixing chamber;

adjusting, with said adjustment control, said rate of flow of said fluid mixture through said choke assembly and into said oil and gas well; and conveying said fluid mixture and debris into said oil and gas well.

53. An apparatus for continually adding chemicals to a producing oil and gas well, wherein production fluid is moved upwardly within said well through a tubing, comprising:

a mixing chamber having an inlet and an outlet;

means for diverting a flow of production fluid from said oil and gas well and directing said flow of production fluid to said inlet of said mixing chamber;

a filter extending transversly within a production fluid flow conduit, through a sidewall of said fluid flow conduit, said filter for passage of said flow of production fluid through said filter and into said means for diverting said flow of production fluid, said filter continually exposed to a passage of production fluid within said production fluid flow conduit and continually cleansed by said passage of said production fluid within said production fluid flow conduit;

means for admitting an amount of chemical into said mixing chamber;

wherein a fluid mixture of said production fluid and said chemical is exhausted from said mixing chamber through said outlet;

means for conveying said fluid mixture from said outlet into said oil and gas well; and whereby said fluid mixture flushes downwardly into said oil and gas well to be pumped upwardly through said tubing.

54. An apparatus for continually adding chemicals to a producing oil and gas well, wherein production fluid is moved upwardly within said well through a tubing, comprising:

a mixing chamber having an inlet and an outlet;

means for diverting a flow of production fluid from said oil and gas well and directing said flow of production fluid to said inlet of said mixing chamber;

means for admitting an amount of chemical into said mixing chamber;

wherein a fluid mixture of said production fluid and said chemical is exhausted from said mixing chamber through said outlet;

flow control means, in fluid communication with said outlet of said mixing chamber, for permitting only a predetermined flow rate of said fluid mixture from said mixing chamber;

an adjustment means, responsive to a pressure within said mixing chamber, for automatically adjusting said flow control means to allow passage of debris through said flow control means which would impede the flow of said fluid mixture through said mixing chamber;

means for conveying said fluid mixture from said outlet into said oil and gas well; and whereby said fluid mixture flushes downwardly into said oil and gas well to be pumped upwardly through said tubing.

55. An apparatus according to claim 54, further comprising a pressure responsive valve means communicating with said inlet of said mixing chamber for closing said inlet when said pressure within said mixing chamber exceeds a predetermined value.

56. An apparatus according to claim 54, further comprising a pressure responsive valve means communicating with said inlet of said mixing chamber which includes a ball valve which seats to close said inlet of said mixing chamber when said pressure within said mixing chamber exceeds a predetermined value.

57. An apparatus according to claim 54, for use with a producing oil and gas well wherein production fluid is moved upwardly within said well through a tubing which is centrally disposed within a casing which at least in-part lines said oil and gas well, wherein said fluid mixture of said production fluid and said chemical is exhausted from said mixing chamber into said oil and gas well between said tubing and said casing.

58. An apparatus according to claim 54, further comprising a pressure gauge means communicating with said mixture chamber for registering said pressure therewithin.

59. An apparatus according to claim 54, further comprising a filter element coupled upstream of said inlet for minimizing the passage of debris into said mixing chamber.

60. An apparatus according to claim 59, wherein said filter element is continually exposed to and continually cleansed by a production fluid flowing within a production flow conduit.

61. An apparatus according to claim 54, further comprising a sight glass coupled to said means for conveying to allow visual inspection of passage of said fluid mixture.

62. An apparatus according to claim 54, further comprising bleed valve means in communication with said mixing chamber for sampling said fluid mixture.

63. An apparatus according to claim 54, wherein said mixing chamber is disposed exteriorly of said oil and gas well.

64. An apparatus according to claim 54, further comprising:

a human-operable flow adjustment means for selectively adjusting said predetermined flow rate of said fluid mixture through said chamber.

65. An apparatus according to claim 54, wherein said flow control means defines a fluid passageway which is narrower than said mixing chamber, and which restricts a flow rate of said fluid mixture through said flow control means and determines said predetermine flow rate.

66. An apparatus according to claim 54, wherein said flow control means comprises a first and second members; and wherein said adjustment means automatically displaces said first member with respect to said second member in response to said pressure within said mixing chamber for automatically adjusting said flow control means to allow said debris to pass therethrough.

67. An apparatus of claim 66, wherein said adjustment means automatically displaces said first member with respect to said second member by axially displacing at least one of said first and second members in an axial direction of flow of said fluid mixture through said flow control means.

68. An apparatus according to claim 54, wherein said flow control means comprises a choke having first and second choke members, with at least one intake port in said first choke member and at least one exhaust port in said second choke member; and wherein said adjustment means automatically displaces said first choke member with respect to said second choke member in response to said pressure within said mixing chamber to facilitate passage of debris through said flow control means.

* * * * *